US008302820B2

(12) United States Patent
O'Brien

(10) Patent No.: US 8,302,820 B2
(45) Date of Patent: Nov. 6, 2012

(54) DISPENSER MECHANISM

(75) Inventor: Michael O'Brien, London (GB)

(73) Assignee: Packaging Innovation Ltd, London (GB)

( * ) Notice: Subject to any disclaimer, the term of this patent is extended or adjusted under 35 U.S.C. 154(b) by 338 days.

(21) Appl. No.: 12/678,471

(22) PCT Filed: Sep. 21, 2007

(86) PCT No.: PCT/GB2007/050570

§ 371 (c)(1),
(2), (4) Date: Mar. 16, 2010

(87) PCT Pub. No.: WO2009/037417

PCT Pub. Date: Mar. 26, 2009

(65) Prior Publication Data

US 2010/0206909 A1 Aug. 19, 2010

(51) Int. Cl.
*B67D 7/76* (2010.01)
*B67D 7/78* (2010.01)

(52) U.S. Cl. ..... 222/190; 222/145.5

(58) Field of Classification Search ..... 222/190, 222/181.3, 321.8, 372, 251, 135, 137, 145.5
See application file for complete search history.

(56) References Cited

U.S. PATENT DOCUMENTS 4,238,056 A * 12/1980 Tucker et al. ..... 222/181.2
4,621,749 A * 11/1986 Kanfer ..... 222/153.01
5,033,657 A 7/1991 Whittington
5,165,577 A * 11/1992 Ophardt ..... 222/181.2
5,265,772 A * 11/1993 Bartasevich et al. ..... 222/214
5,373,970 A * 12/1994 Ophardt ..... 222/181.2
5,431,309 A 7/1995 Ophardt
5,445,288 A 8/1995 Banks
5,465,877 A * 11/1995 Bell et al. ..... 222/181.2
5,595,324 A * 1/1997 Brown et al. ..... 222/1
5,779,104 A 7/1998 Reidel
5,810,204 A 9/1998 Devlin et al.
5,918,771 A 7/1999 van der Heijden
6,131,773 A * 10/2000 Wade et al. ..... 222/153.02
6,398,079 B1 6/2002 Garcia et al.

(Continued)

FOREIGN PATENT DOCUMENTS

DE 39 11 089 A1 10/1990

(Continued)

OTHER PUBLICATIONS

Search Report dated Apr. 20, 2007, for Great Britain application No. 0625538.4.

(Continued)

*Primary Examiner* — Kevin P Shaver
*Assistant Examiner* — Vishal Pancholi
(74) *Attorney, Agent, or Firm* — Christie, Parker & Hale, LLP

(57) ABSTRACT

A dispenser mechanism 1 for a foamed product comprises a liquid chamber 9 and air chamber 10, each compressed by a common actuator mechanism 6*a*, 6*b*, wherein the liquid and air simultaneously enter a foaming chamber 15. The liquid is forced through a diffuser 18*a* defining a plurality of distributed channels 18*e*, each channel 18*e* having a predetermined cross section such that in use the liquid is forced through the channels and enters the foaming chamber as a plurality of jets. The dispenser mechanism 1 provides a particularly advantageous arrangement for producing foam and may be arranged to prevent the foam dripping from an outlet after the end of a dispensing cycle.

18 Claims, 11 Drawing Sheets

U.S. PATENT DOCUMENTS

| | | | | |
|---|---|---|---|---|
| 6,533,145 | B2 * | 3/2003 | Lewis et al. | 222/181.3 |
| 6,575,335 | B2 * | 6/2003 | Lewis et al. | 222/156 |
| 6,832,701 | B2 * | 12/2004 | Schiller | 222/181.3 |
| 6,877,642 | B1 * | 4/2005 | Maddox et al. | 222/181.3 |
| 7,066,357 | B2 | 6/2006 | Ciavarella et al. | |
| 7,086,567 | B1 | 8/2006 | Ciavarella et al. | |
| 7,147,133 | B2 | 12/2006 | Brouwer et al. | |
| 7,222,752 | B2 | 5/2007 | Ponton | |
| 7,225,948 | B2 | 6/2007 | Ophardt et al. | |
| 7,367,477 | B2 | 5/2008 | Ophardt et al. | |
| 7,798,370 | B2 | 9/2010 | Ciavarella et al. | |
| 2002/0074355 | A1 * | 6/2002 | Lewis et al. | 222/181.3 |
| 2002/0074356 | A1 * | 6/2002 | Lewis et al. | 222/181.3 |
| 2003/0127470 | A1 * | 7/2003 | DeKoning et al. | 222/180 |
| 2004/0232168 | A1 * | 11/2004 | Ciavarella et al. | 222/156 |
| 2005/0006408 | A1 | 1/2005 | Ganzeboom | |
| 2005/0092771 | A1 * | 5/2005 | Ciavarella et al. | 222/129 |
| 2005/0133537 | A1 * | 6/2005 | Lewis et al. | 222/181.3 |
| 2005/0284887 | A1 * | 12/2005 | Lewis et al. | 222/181.3 |
| 2006/0175353 | A1 * | 8/2006 | Ophardt et al. | 222/181.3 |
| 2006/0249538 | A1 * | 11/2006 | Ophardt et al. | 222/181.3 |

FOREIGN PATENT DOCUMENTS

| | | | |
|---|---|---|---|
| EP | 0 275 836 | | 7/1988 |
| EP | 0 613 728 | A2 | 9/1994 |
| EP | 1 433 533 | A1 | 6/2004 |
| FR | 2 792 553 | | 10/2000 |
| GB | 818363 | | 8/1959 |
| GB | 1 447 011 | | 8/1976 |
| GB | 2 380 470 | A | 4/2003 |
| JP | 9-503161 | | 3/1997 |
| JP | 09-187692 | | 7/1997 |
| JP | 9-193953 | | 7/1997 |
| WO | WO 99/49769 | | 10/1999 |
| WO | WO 00/78629 | A1 | 12/2000 |
| WO | WO 01/81004 | A1 | 11/2001 |
| WO | WO 2005/039371 | A1 | 5/2005 |

OTHER PUBLICATIONS

Search Report dated Jun. 18, 2007, for Great Britain application No. 0704704.6.

International Search Report and Written Opinion dated Oct. 1, 2007 for PCT/GB2007/050150.

U.S. Office Action dated Apr. 24, 2012 in related U.S. Appl. No. 12/226,787 (17 pages).

International Search Report and Written Opinion of corresponding International application PCT/GB2007/050570, dated Jul. 23, 2008.

English Translation of Japanese Office Action dated Jul. 10, 2012 for Patent Application No. 2010-525416, 2 pages.

* cited by examiner

DISPENSER MECHANISM

CROSS-REFERENCE TO RELATED APPLICATION

This application is a National Phase Application and claims the priority of International Application Number PCT/GB2007/050570 filed on Sep. 21, 2007.

BACKGROUND OF THE INVENTION

1. Field of the Invention

The present invention relates to a dispenser mechanism for foamed products and particularly, but not exclusively, relates to dispenser mechanisms for wall mounted soap dispensers.

2. Description of the Related Art

Wall mounted soap dispensers traditionally dispense a liquid soap. However, with liquid soap it is necessary for the viscosity to be high enough that it can be applied to the hands without running off, enabling the soap to cling to the hands while being conveyed from under the dispenser to over the sink. Two problems associated with the high viscosity of liquid soaps is that it is necessary to dispense a relatively large quantity to enable the user to easily spread the soap over the surface of his hands and also this high viscosity tends to result in a large quantity of the soap remaining in the outlet of the dispenser, which subsequently drips onto the surface or the floor below.

In an attempt to address the above problems, soap dispensers have been developed which produce foam by mixing air with the liquid soap as it is dispensed. The action of operating the dispenser causes a soap product to be sprayed into a jet of air to produce the foam. The advantage of this is that a large quantity of foam can be produced from a relatively small volume of liquid soap, reducing the amount of liquid a user requires to satisfactorily apply the soap over his hands. This reduces the cost of product required and also the frequency with which the dispenser needs to be refilled. Thus foam dispensers overcome one of the problems identified above associated with traditional liquid soap dispensers. However many foam dispensers still tend to drip as foam accumulated in the nozzles reverts to a liquid causing the nozzle to drip.

BRIEF SUMMARY OF THE INVENTION

It is desirable that the dispenser mechanism is compact and comprises a minimum of components so that it may be relatively inexpensive and therefore practical to produce a dispenser mechanism which can be sold as part of the refill pack for a dispenser, thus the parts likely to fail are part of the disposable refill and can thus, in the event of a failure, can simply be replaced by replacing the refill pack.

It is an object of the present invention to provide an improved dispenser mechanism for foam products.

According to a first aspect of the present invention a dispenser mechanism for a foamed product comprises: a liquid chamber arranged to receive a liquid product; an air chamber arranged to receive air; an actuator mechanism; and a foaming chamber, the actuator mechanism comprising a shaft, displacement of which simultaneously reduces the volume of both the liquid and air chambers and forces the air and liquid within the respective chambers to enter the foaming chamber, characterised in that the foaming chamber is formed integrally within the shaft and in that a diffuser is located in the shaft through which the liquid enters the foaming chamber, the diffuser defining a plurality of distributed channels, each channel having a predetermined cross section such that in use the liquid is forced through the channels and enters the foaming chamber as a plurality of jets.

The invention permits efficient mixing of the liquid and air in a very compact arrangement.

Preferably, the actuator mechanism comprises two pistons on a common shaft, each piston acting on respective one of the liquid and air chambers, for in this way it is possible to have a dispenser mechanism which employs only one single moving part, which reduces costs associated with manufacturer and thus is particularly beneficial if the dispensing mechanism is to be part of a disposable refill pack.

Advantageously, a first chamber is in the form of a cylinder in to which a first one of the pistons extends to pressurise the contents of the chamber and wherein the foaming chamber is formed in the shaft, as this can provide a very compact arrangement.

Preferably, the actuator mechanism is biased to a rest position where both pistons are withdrawn to their maximum extent from their respective chambers. When in the rest position, the liquid chamber can be sealed, preventing liquid seeping through the dispenser mechanism.

It is particularly advantageous if the action of the actuator mechanism returning to its rest position sucks air into the air chamber via an outlet of the dispenser mechanism, causing any foam remaining in the outlet to be sucked back into the air chamber and thus preventing the foam from reverting to a liquid in the outlet and dripping from the outlet.

Advantageously, the liquid chamber has a one way valve to permit liquid to enter the chamber when the piston is withdrawn from the chamber, wherein the dispenser mechanism includes a transport cap arranged to prevent accidental operation of the actuator mechanism in transit, the transport cap being arranged to keep the actuator mechanism in a fully depressed position where the piston of the liquid chamber is in contact with the one way valve and maintains it in a closed position. This may be particularly advantageous where the dispensing mechanism is to be sold as part of a disposable refill pack for assembly as a complete unit within a wall mounted housing. This can ensure that pressures applied to the walls of the liquid container, which is normally a non-vented collapsible container, will not cause the liquid within the container to leak out via the dispenser mechanism.

The diffuser may have a plurality of recesses about its outer periphery, which recesses define with the inner wall of the shaft said plurality of channels. The recesses can then be formed in the moulding of an upper component of the shaft, on which the diffuser is preferably integrally formed. Alternatively the periphery of the diffuser may be smooth with ridges or recesses formed on the inner wall of the shaft, such when the diffuser is located in the shaft, the diffuser and inner wall of the shaft together define said plurality of distributed channels.

As an alternative to the above described embodiments of the diffuser, the diffuser may instead comprise a rigid disc with a plurality of apertures extending there through.

Preferably the shaft comprises an upper component and a lower component, each moulded as a single piece, wherein the upper component includes a first piston and the diffuser, the lower component includes a second piston and an outlet passage of the mechanism. The upper component of the shaft may further comprise a retaining disc integrally moulded with the first component, wherein an edge of the retaining disc and an inner wall of the shaft are arranged to engage with each other to lock the upper and lower components together. This enables the shaft to comprise only two components that together form the two pistons, the mixing chamber and the diffuser, with the retainer enabling the two components to be assembled simply by snapping them together.

A dispenser mechanism in accordance with the invention is particularly advantageous in manually operated applications, such as soap dispensers.

Preferably, the dispenser mechanism further comprises a user interface for receiving a single stroke actuation by a user for dispensing a predetermined quantity of product to the user and a linkage mechanism for transferring, on a full stroke of the dispenser mechanism, any displacement of the user interface to the dispensing mechanism, wherein the linkage mechanism permits the user interface to be operated to the full extent permitted by the interface and transmit only as much of the operation of the interface to be transmitted to the dispenser mechanism as is required to permit the dispenser mechanism to dispense the predetermined amount of product.

This mechanism is particularly advantageous for it can be arranged to ensure that any reasonable exertion on the user interface causes the dispenser mechanism to operate fully and thus provide a desired volume of product, while ensuring that any excessive pressure applied to the user interface does not damage the dispenser mechanism. It can also permit a single dispenser case to be used with a range of products and product volumes without modification, or to allow a common dispenser mechanism to be adjusted to provide different product volumes by adjusting the dispenser mechanism stroke length. It also prevents damage to the dispenser mechanism that occurs when the pump mechanism controls the actuation stroke of the dispenser interface.

Advantageously, the linkage mechanism comprises a resilient device between the interface and dispenser mechanism, properties of the resilient device being sufficient to fully activate the dispenser mechanism when the interface is sufficiently operated, but which absorbs any further movement of the interface to prevent damage to the dispenser mechanism.

The invention is particularly applicable to soap dispensers arranged to permit single handed one stroke operation.

BRIEF DESCRIPTION OF THE DRAWINGS

One embodiment of the present invention will now be described, by way of example only, with reference to the figures, in which like numerals are used throughout to indicate like parts, and in which.

DETAILED DESCRIPTION

Figure 1:
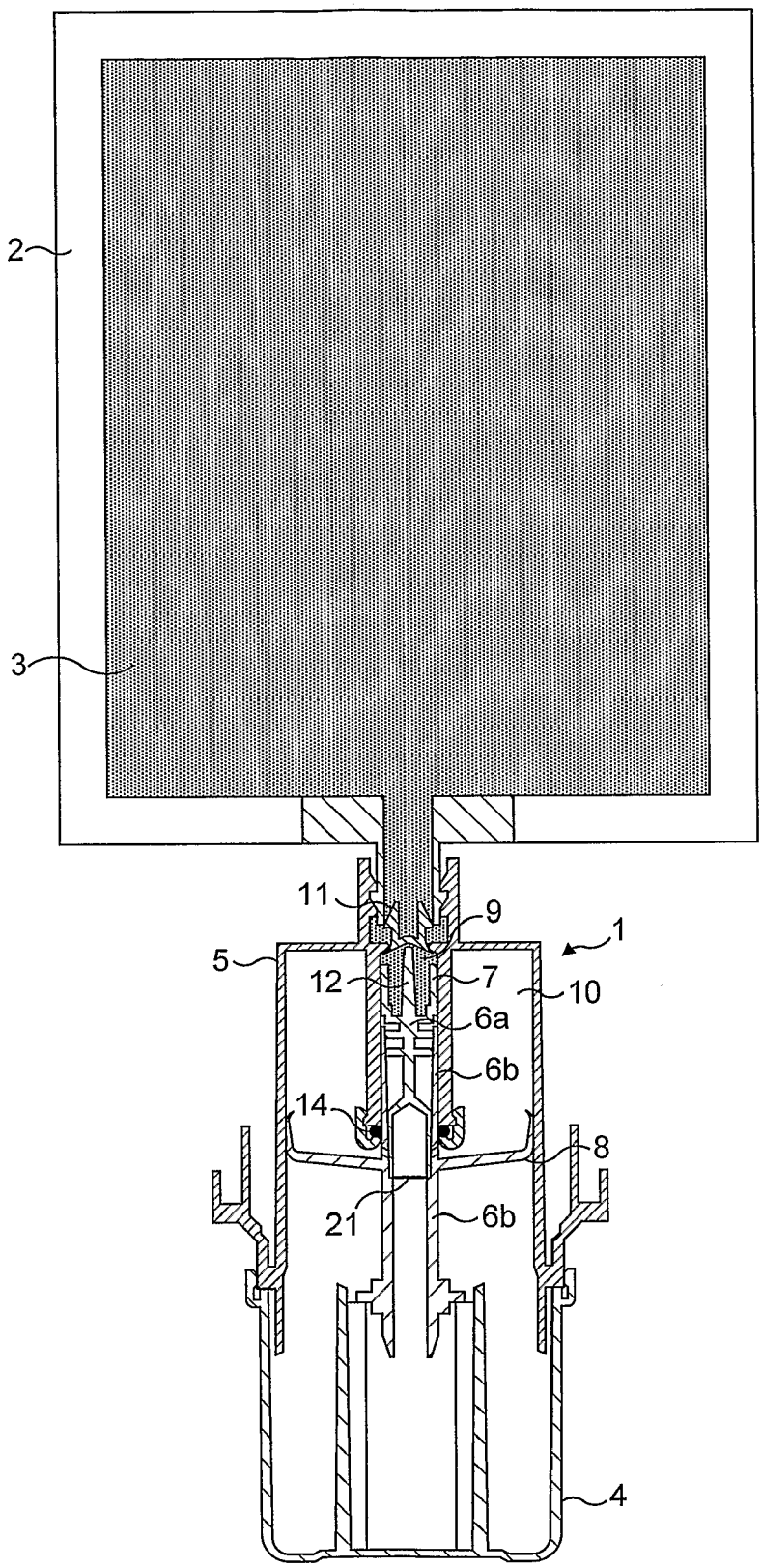
FIG. 1 is a cross-section through a dispensing mechanism in accordance with the present invention, with a transport cap in place.

Referring to FIG. 1, there is illustrated a dispenser mechanism 1 in accordance with the present invention connected to a disposable collapsible container 2 filled with liquid soap 3. The container 2 and dispenser mechanism 1 together form a disposable refill pack for wall mounted soap dispensers.

The dispenser mechanism of FIG. 1 is transported attached to the filled container 2 and the dispenser mechanism comprises a transport cap 4, secured to the housing 5 of the dispenser mechanism. This prevents accidental actuation of the dispenser mechanism prior to installation in a dispenser, or leakage due to compression of the collapsible container 2.

The dispenser mechanism has a shaft 6 comprising an upper component 6*a* and a lower component 6*b*, joined together such that in use there is no relative displacement between them. The upper component 6*a* defines a first piston 7 and the lower component 6*b* defines a second piston 8.

The first piston 7, together with the housing 5, defines a first chamber 9, with the second piston 8 defining with the housing 5 a second chamber 10.

In the top of the first chamber 9 there is an opening, in which opening there is located a non-return valve 11. When open, the non-return valve 11 permits liquid soap 3 to flow from the container 2 to the first chamber 9.

When the transport cap is in place, as shown in FIG. 1, the shaft 6 and associated piston 7 and 8 are retained in a fully depressed, (raised), position whereby a pin 12, extending from the centre of the first piston 7, engages with the non-return valve 11 to keep it in a closed position, as shown. This ensures that during transit, fluid cannot leak from the container 3 through the dispenser mechanism 1.

Figure 2A:
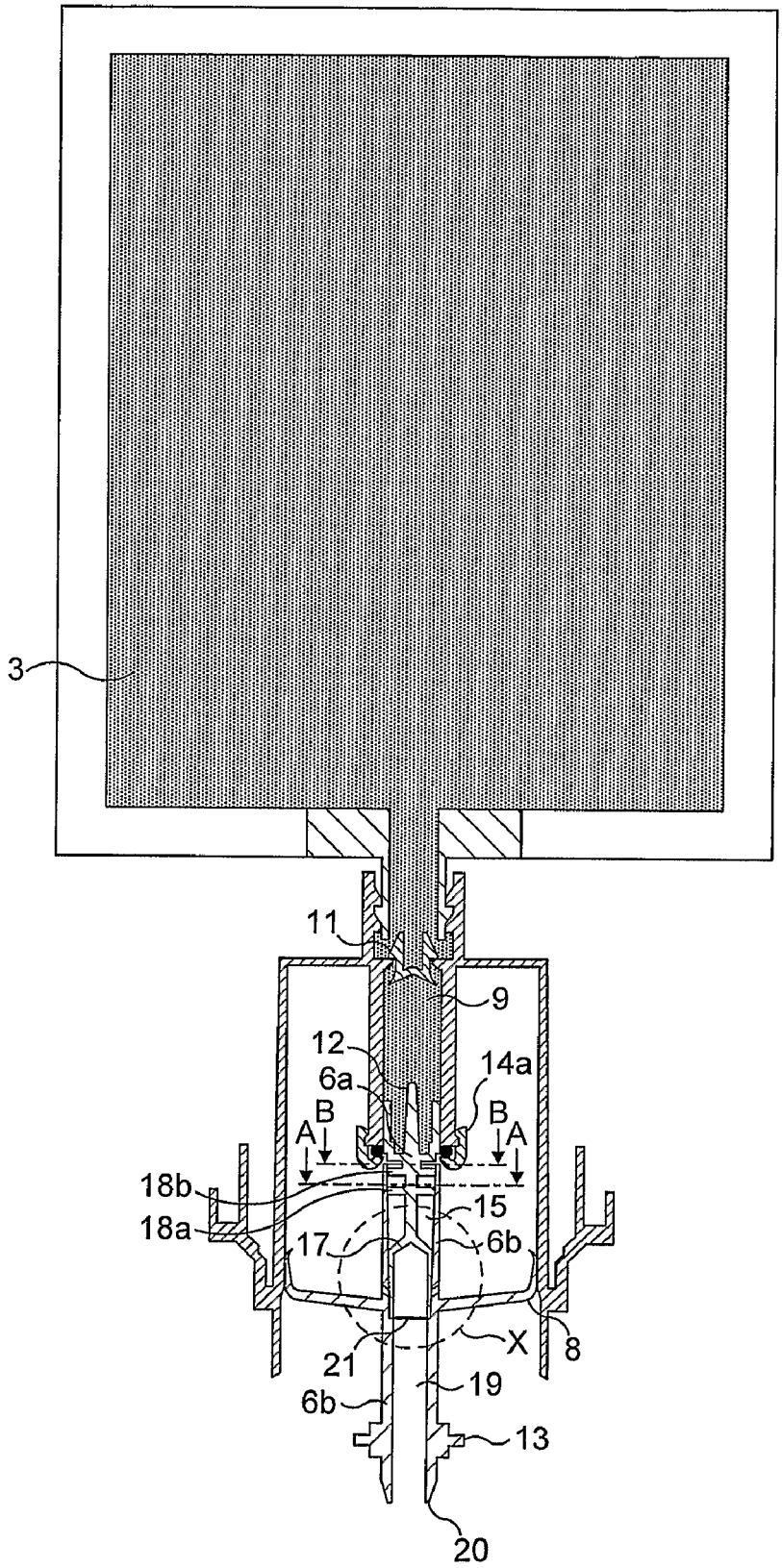
FIG. 2*a* is a corresponding cross-section to that of FIG. 1 but with the transport cap removed.

Referring now to FIG. 2*a*, a corresponding view to that of FIG. 1 is shown but with the transport cap 4 removed. When the transport cap is removed and the dispenser mechanism installed in a dispenser (as described below with reference to FIGS. 6*a* to 10*b*) the mechanism of the dispenser, not shown in FIG. 2*a*, biases flange 13 located towards the bottom of lower component 6*b* of the shaft 6 to the position shown in FIG. 2*a*. In this position rubber O-ring seal 14 seals with the first piston 7 preventing the liquid soap 3 passing between the outer wall of piston 7 and the inner wall of the housing 5. The O-ring 14 is retained in place by end cap 14*a*. Drawing the shaft 6 downwards causes liquid soap 3 to flow into the first chamber 9.

Figure 2B:
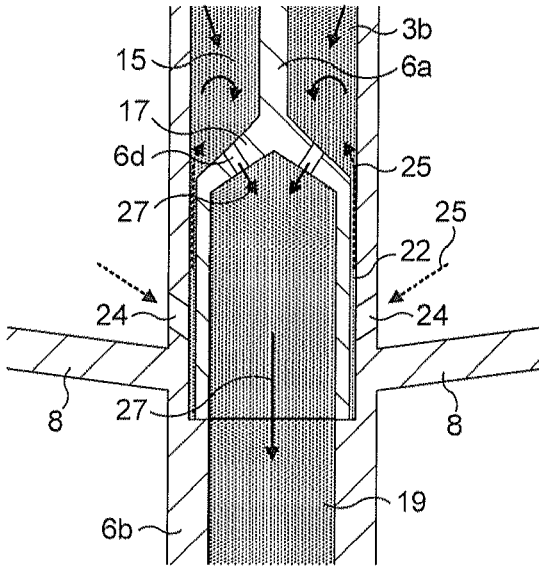
FIG. 2*b* is an enlarged scale view of the section labelled 'X' of FIG. 2.
Figure 2C:
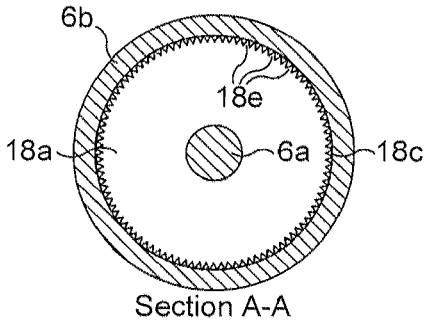
FIG. 2*c* an enlarged scale section along the line A-A of FIG. 2.

As most clearly seen in FIG. 2*b*, the upper component 6*a* of shaft 6 and the lower component 6*b* of shaft 6 define, at the lowermost portion of the component 6*a*, channels 22 between the components 6*a* and 6*b*. When the shaft 6 is raised by means of flange 13, air in the second chamber 10 is compressed and passes through apertures 24 and channels 22 in the lower component 6*b*, in the direction of arrows 25, to a mixing chamber 15.

Referring again to FIG. 2*a*, the upper component 6*a* of the shaft 6 additionally comprises two disc like members 18*a* and 18*b*. The upper disc like member 18*b* is a retainer and is shown in plan view in FIG. 2*d*, a section along the line A-A of FIG. 2*a*. The retainer 18*b*, forming part of the upper component 6*a* of shaft 6, has a narrow peripheral edge section which engages in a circumferential slot in the inner wall of the lower component 6*b* of the shaft 6. This locks the two components 6*a* and 6*b* together. Apertures 18*d* in retainer 18*b* permit fluid to pass there through, as described below.

The lower disc like member 18*a*, of FIG. 2*a*, is a diffuser and has an outer serrated edge 18*c*. This edge together with the inner wall of the lower component 6*b* of shaft 6 defines a plurality of channels 18*e*, each of a predetermined cross section, extending into a mixing chamber 15, also defined by the upper component and the inner wall of the lower component 6*b* of the shaft 6.

Figure 2E:
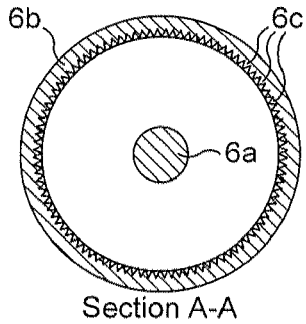
FIG. 2*e* depicts an alternative embodiment of the invention.
Figure 2D:
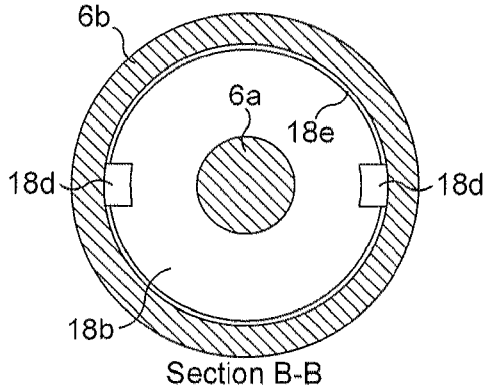
FIG. 2*d* an enlarged scale section along the line B-B of FIG. 2.

In the embodiment shown in FIG. 2*a*, the channels 18*e* are formed by the serrated edge 18*c* of the diffuser 18*a* engaging the inner wall of component 6*b*. However in alternative arrangements, the channels could be formed as distributed apertures through the diffuser 18*a*, or, as shown in FIG. 2*e*, the diffuser could have a smooth outer edge and the inner wall of component 6*b* could have vertical ridges 6*c* thereon, which would, in combination with the edge of the diffuser 18*a*, define the channels. Each arrangement permits liquid soap to be injected into the mixing chamber 15 via a number of distributed channels, each of a predetermined cross section, which is not dependent on the pressure of the liquid soap passing there through, (represented by the arrows 3*b* of FIG. 2*b* and FIG. 3).

Figure 3:
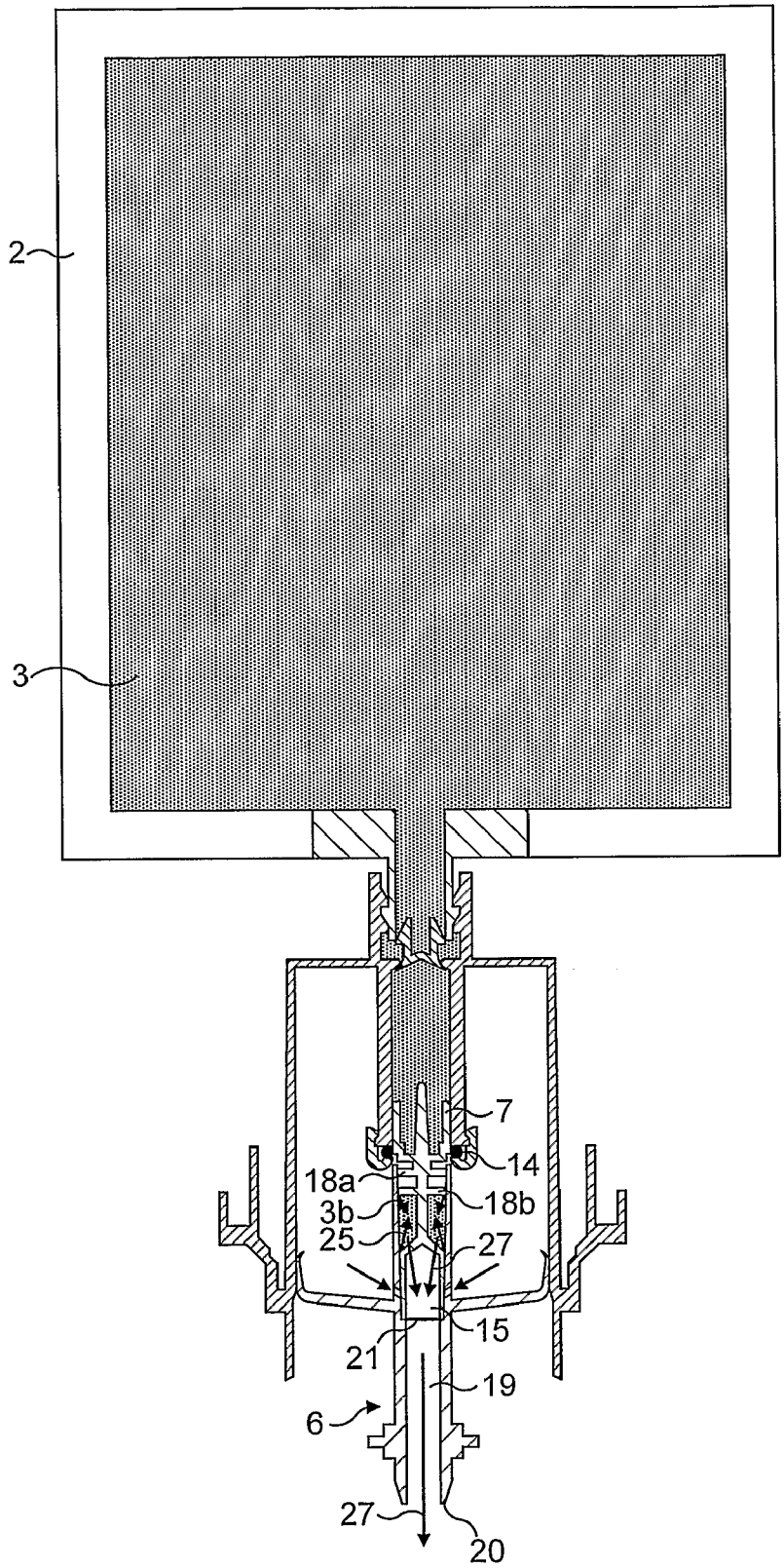
FIGS. 3 to 5 are sectional views corresponding to that of FIG. 2*a*, but depicting the dispensing mechanism at various stages of operation.

As seen from FIG. 3, when the shaft 6 is raised by the operation of the dispenser acting on flange 13 (relative to the position shown in FIG. 2*a*), the upper component 6*a* of shaft 6 moves to a position where the piston 7 is no longer sealed by the O-ring 14, permitting liquid soap 3, displaced by the action of the piston 7 entering the first chamber 9, to be forced down the side of the first piston 7 through apertures 18*d* of the retainer 18*b*, and to enter into the channels 18*e* of the diffusers 18*a*. The liquid 3 is sprayed under pressure as a plurality of jets from the channels into the mixing chamber 15. Simultaneously, air is forced into the mixing chamber in the direction of arrows 25 causing the air and liquid to intermingle before exiting the mixing chamber 15 as a foam, via apertures 6*d* in the conical section 17 of the upper component 6*a* of shaft 6, as shown in FIG. 2*b*.

As illustrated by FIGS. 2*a* and 3, the foam passes in the direction of arrows 27 down a central passage 19 formed by the lower component 6*b* of shaft 6 through a gauze 21, which aggregates the foam bubble size, to outlet 20.

Figure 4:
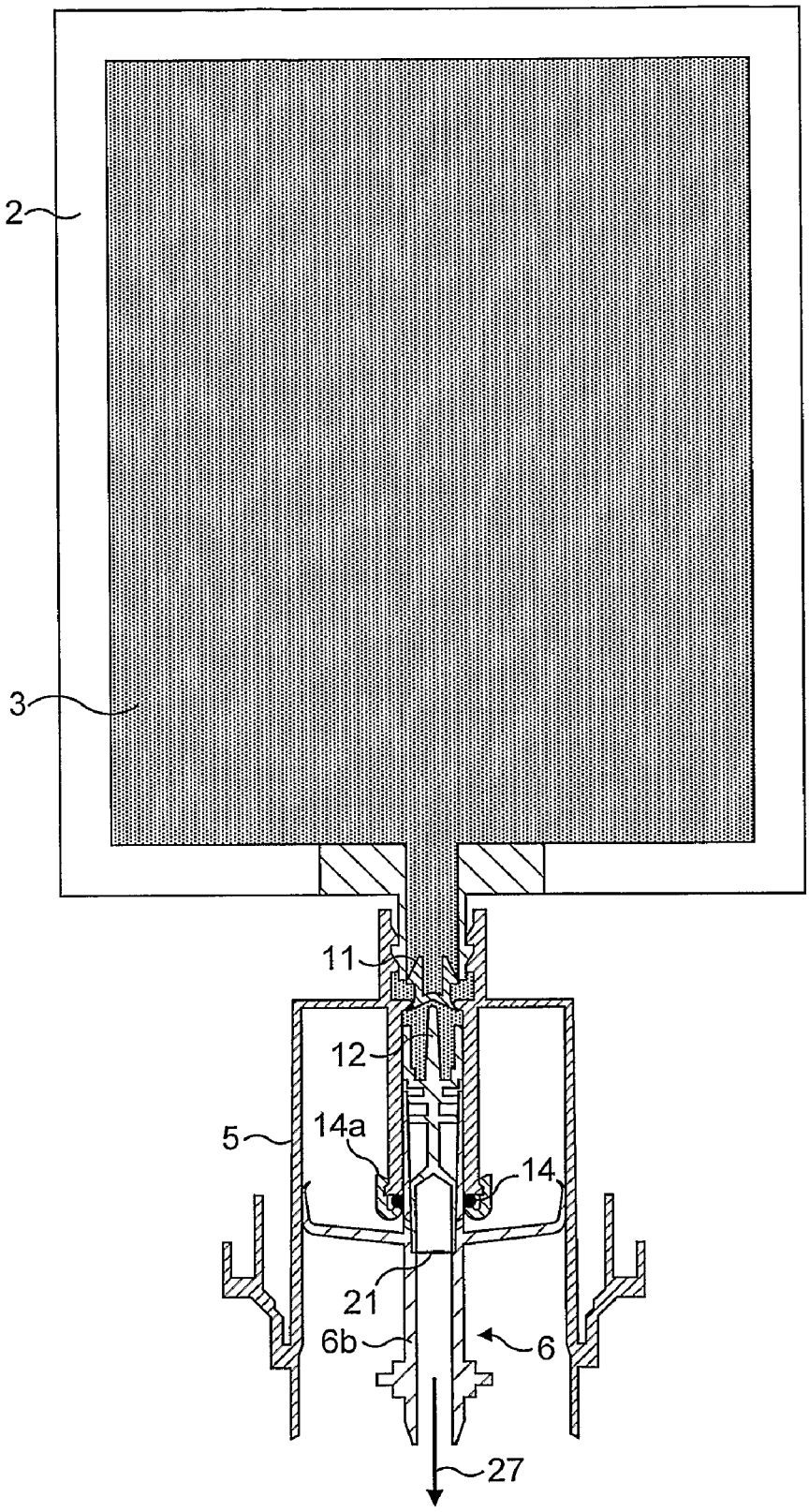

FIG. 4 is a corresponding view to FIG. 3 but shows the dispenser mechanism when the shaft 6 is fully depressed (raised) and reaches the limit of its travel.

Figure 5:
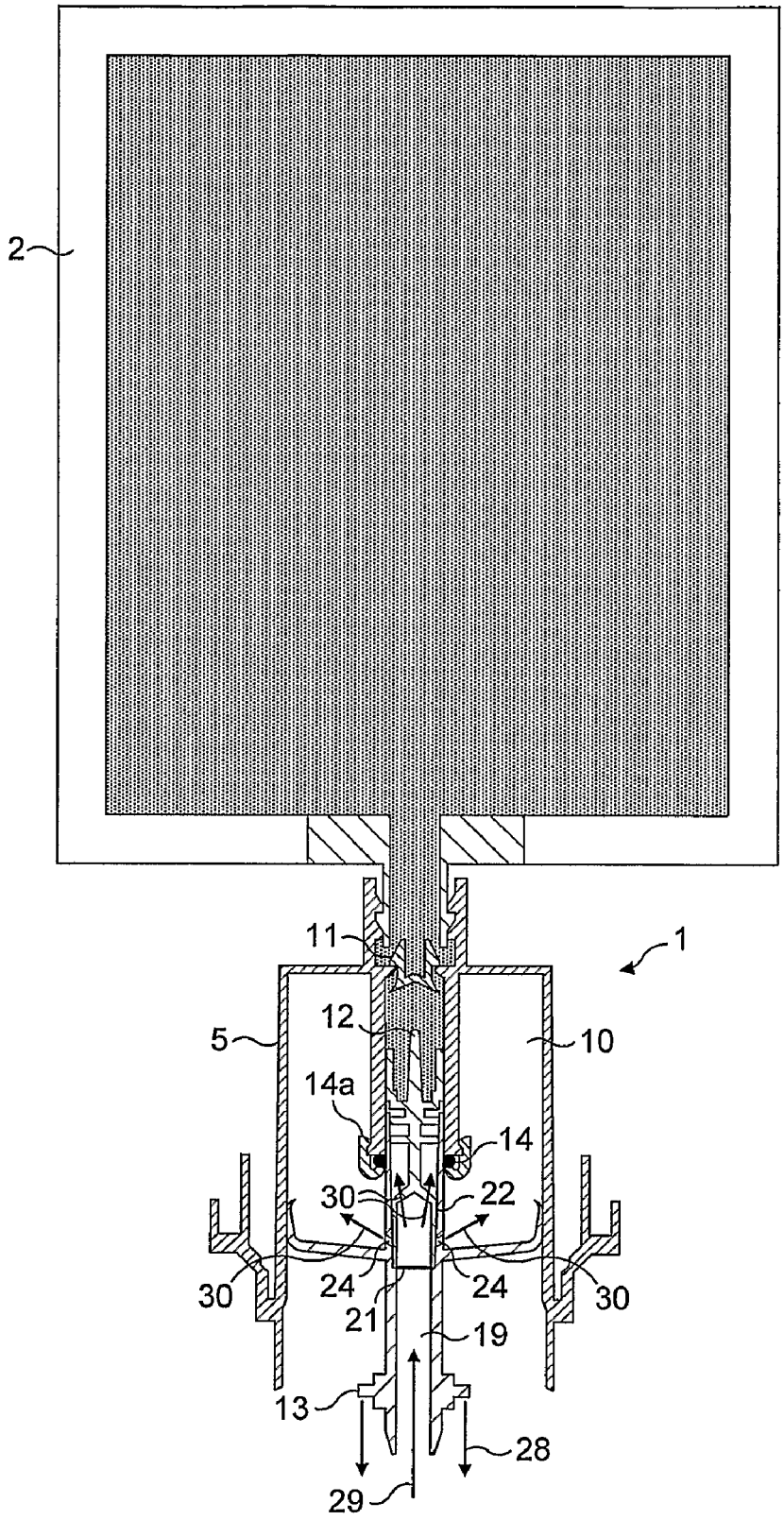

FIG. 5 corresponds to FIG. 4, but shows the dispensing mechanism 1 midway through its return stroke, the dispensing mechanism being acted upon by the dispenser (not shown) drawing flange 13 in the direction of arrows 28 back to its rest position. During this part of the cycle, the expanding volume within the second chamber 10 draws air into the second chamber through the passage 19, channels 22 and apertures 23, as represented by arrows 29 and 30. This draws any foam remaining in the passage 19 back into the bottom of the chamber 10, from where it will be expelled back through the channels 22 to the mixing chamber 15 at the start of the next dispensing cycle. This ensures that at the end of the dispensing cycle passage 19 is free of foam and thus will not drip as the foam reverts back to liquid. With subsequent dispensing actions the volume of liquid soap 3 within the container 2 will be reduced and the container will collapse.

Figure 6A:
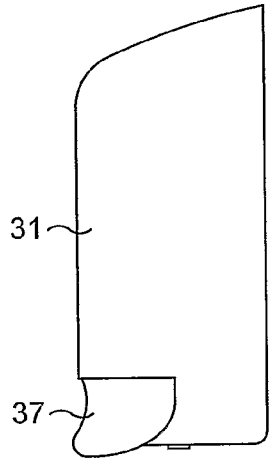
FIG. 6*a* is a side elevation of the dispenser mechanism additionally illustrating a user interface for the dispenser mechanism described with reference to FIGS. 1 to 8.
Figure 6B:
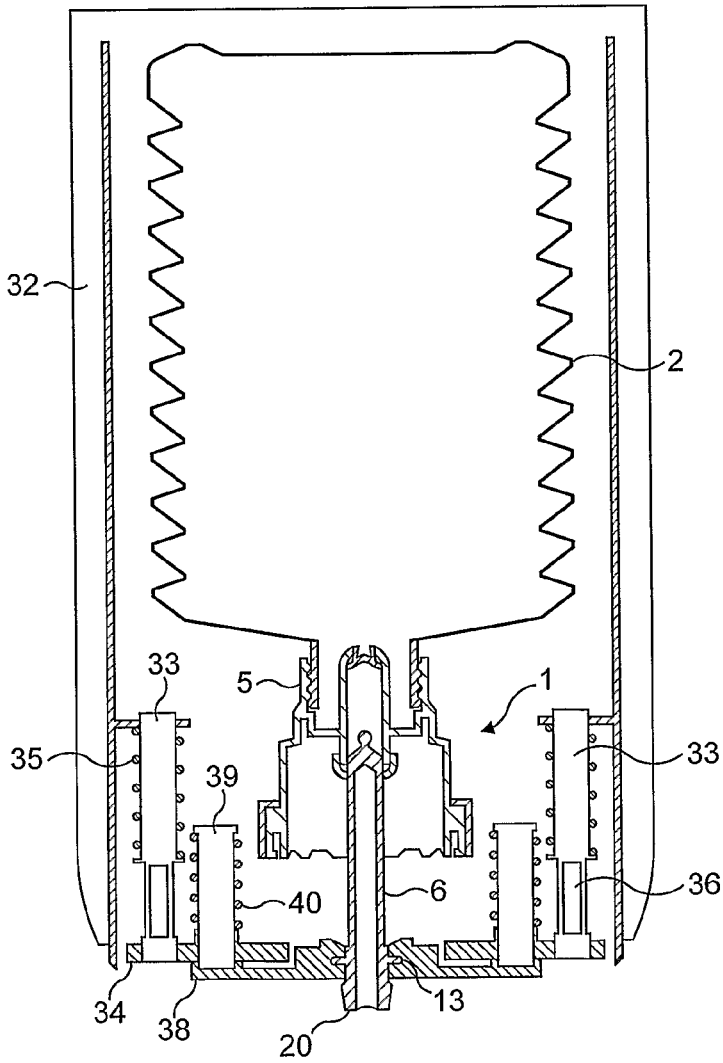
FIG. 6*b* is a front sectional view of the dispenser of FIG. 6*a*.

FIG. 6*a* is a side elevation of a wall mounted liquid soap dispenser 31 having an actuator handle 37 and FIG. 6*b* is a front sectional view through the dispenser 31. The dispenser 31 comprises a back plate 32 providing mounting for the dispenser mechanism 1 of FIGS. 1 to 5, shown here with an alternative type of collapsible container 2.

The dispenser 31 has a main pillars 33 which are constrained and run in vertical bearing surfaces on the back plate 32. The pillars 33, located to either side of the dispenser, are attached to a main plate 34 as shown, with springs 35 acting between the main plate 33 and back plate 32 maintaining the main plate 34 in its lower position as shown.

Slots 36 in each of the main pillars 33 engage with pegs (not shown) of the actuator handle 37 of FIG. 6*a*, which handle provides a user interface by which a user may operate the dispenser. A user pressing the handle 37 causes the pegs of the handle to vertically raise the main pillars 33.

A travelling plate 38 is attached by auxiliary pillars 39, which auxiliary pillars 39 pass through holes in the main plate 33, with springs 40 acting between a shoulder on the top of the auxiliary pillars 39 and the main plate 34 to retain the travelling plate in an upper position next to the main plate 34, as shown. The travelling plate 38 is also attached to the flange 13 on the shaft 6 of the dispensing mechanism 1, such that the shaft 6 moves with the travelling plate 38.

Figure 7A:
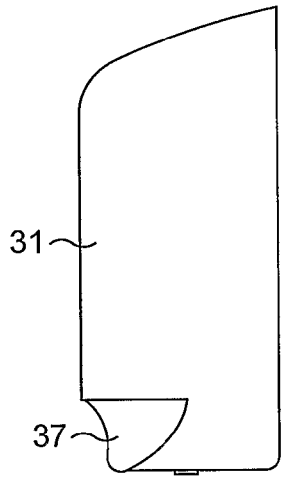
FIGS. 7*a*, 7*b*, 8*a*, 8*b*, 9*a*, 9*b*, 10*a* and 10*b*, correspond to those of FIGS. 6*a* and 6*b*, but show the dispenser at various stages of operation in the dispensing cycle.
Figure 7B:
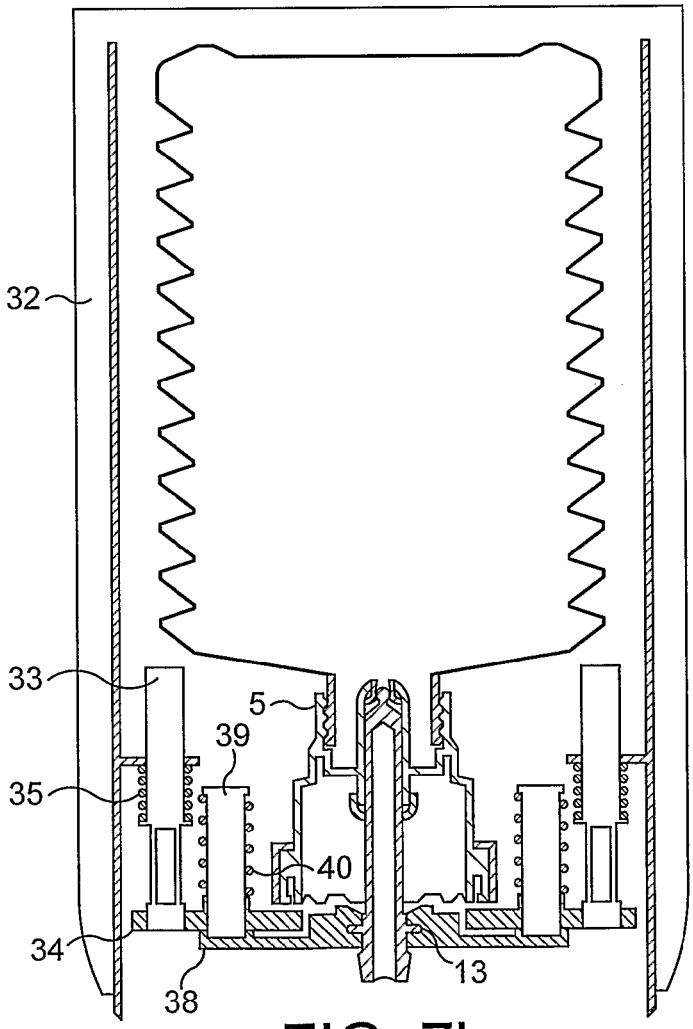

Referring now to FIGS. 7*a* and 7*b*, these correspond to those of FIGS. 6*a* and 6*b* but show the dispenser at full stroke, when the handle 37 has been fully depressed and is restrained by stops associated with the handle. The action of pressing the handle has raised the main pillars 33 to the position shown, whereby this in turn has raised the main plate 34, travelling plate 38 and shaft 6 to its fully raised position, dispensing a predetermined quantity of foam.

Figure 8A:
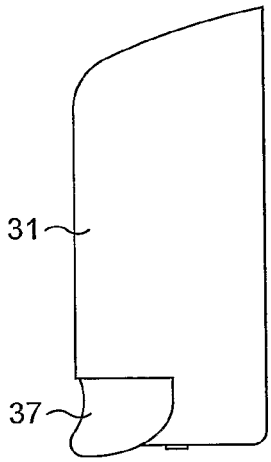
Figure 8B:
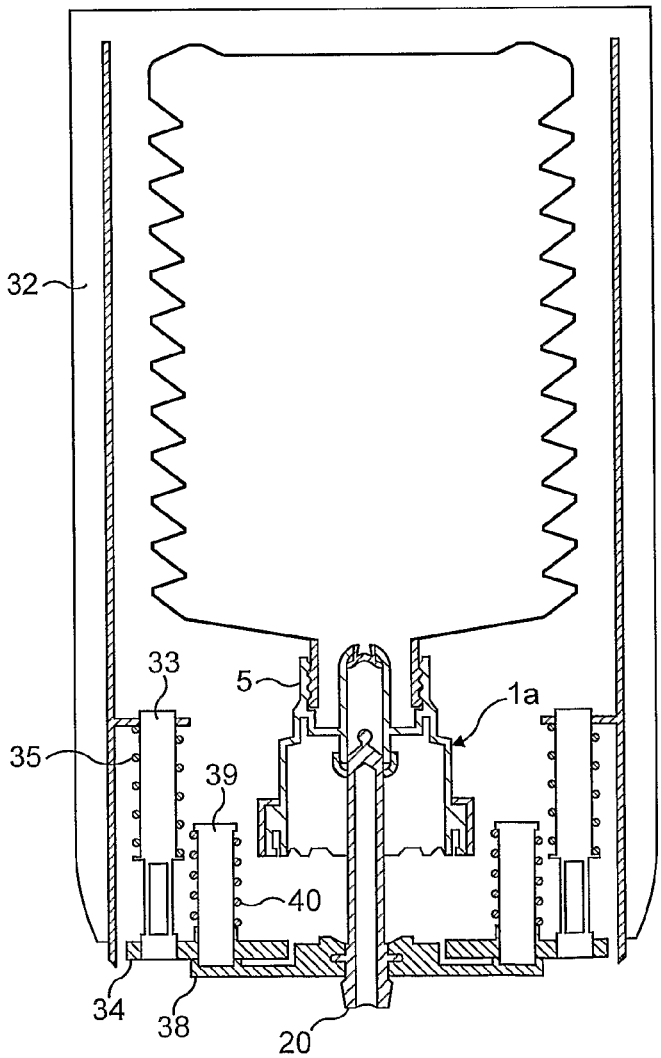
Figure 9A:
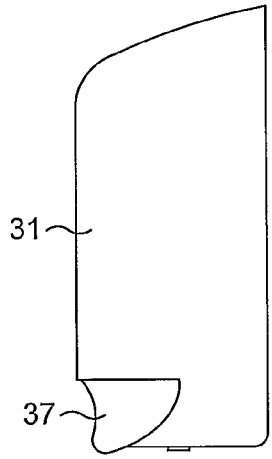
Figure 9B:
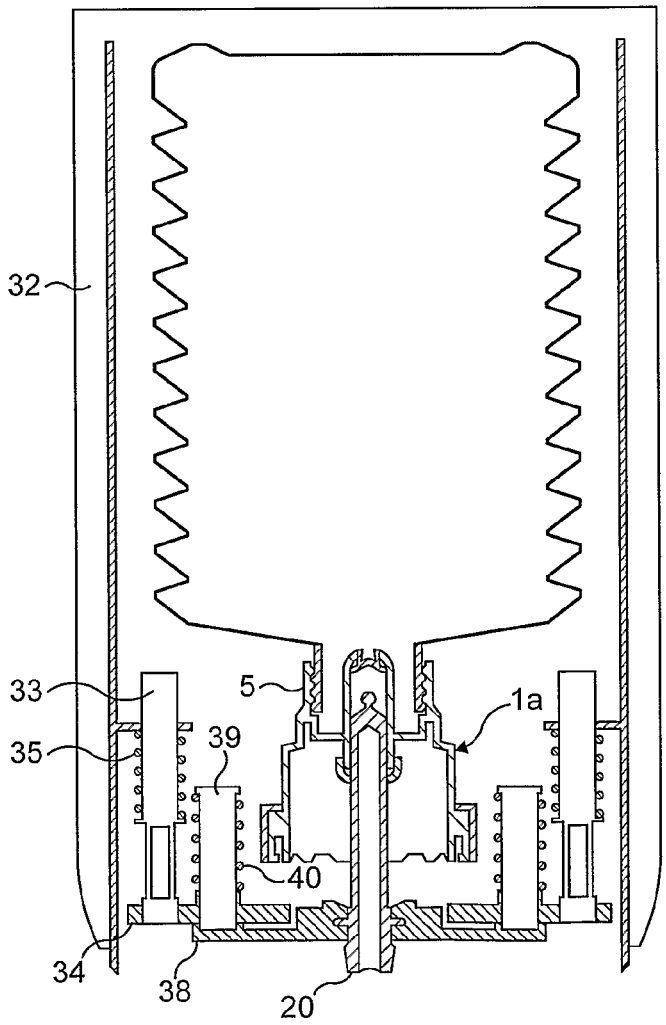
Figure 10A:
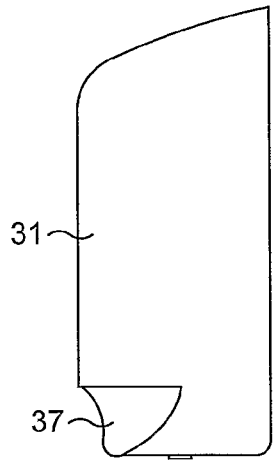
Figure 10B:
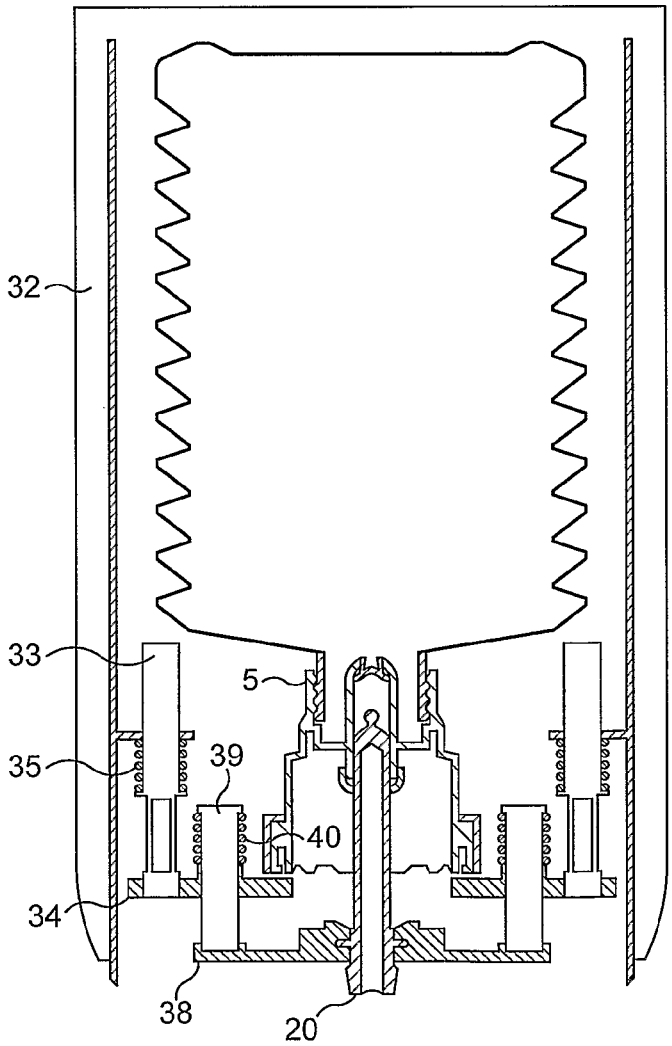

Referring to FIGS. 8*a* and 8*b*, there is shown the same dispenser 31 fitted with an alternative dispensing mechanism 1*a* which has a reduced operating stroke. The dispensing mechanism 1*a* is fitted to the dispenser 31, in the same manner as previously described with reference to FIGS. 6*a* to 7*b*. However, as shown in corresponding FIGS. 9*a* to 9*b*, partial depression of the handle 37 will complete a full stroke of the dispenser mechanism. If the handle 37 was directly linked to the dispenser mechanism 1*a*, then further force depression of the handle 37, which often occurs as a user will commonly "thump" the handle, would result in damage to the dispenser mechanism. However, as illustrated in FIGS. 10*a* and 10*b*, further depression of the handle 37, to complete a full stroke of the handle, causes the travelling plate 38 to move away from the main plate 34 against the force exerted by springs 40. Thus, the springs 40 act as a resilient means absorbing the extra displacement. This permits the dispenser 31 to be used with dispenser mechanisms having different full stroke lengths or may be arranged to permit the stroke length of the dispensing mechanism to be varied in order to control the quantity of foam, or other product to be dispensed.

The embodiment described above is given by way of example only and the scope of the invention is to be determined with reference to the appended claims.

The invention claimed is:

1. A dispenser mechanism for a foamed product comprises: a liquid chamber arranged to receive a liquid product; an air chamber arranged to receive air; an actuator mechanism; and a foaming chamber, the actuator mechanism comprising a shaft, displacement of which simultaneously reduces the volume of both the liquid and air chambers and forces the air and liquid within the respective chambers to separately enter the foaming chamber, wherein the foaming chamber is formed integrally within the shaft and the dispenser mechanism further comprising a diffuser located in the shaft through which the liquid enters the foaming chamber, the diffuser defining a plurality of distributed channels, each channel having a predetermined cross section such that in use the liquid is forced through the channels and enters the foaming chamber as a plurality of jets where the liquid of the jets intermingles with air in the foaming chamber.

2. A dispenser mechanism as claimed in claim 1, wherein the actuator mechanism comprises a first and a second piston located on the shaft, each piston acting on a respective one of the liquid and air chambers.

3. A dispenser mechanism as claimed in claim 2, wherein a liquid chamber is in the form of a cylinder into which the first piston extends to pressurise the liquid in the liquid chamber and wherein the foaming chamber is formed in the shaft.

4. A dispenser mechanism as claimed in claim 1, wherein the actuator mechanism is biased to a rest position where the pistons associated with each respective chamber are withdrawn to their maximum extent from their respective chambers.

5. A dispenser mechanism as claimed in claim 4, wherein in the rest position the liquid chamber is sealed by its associated piston.

6. A dispenser mechanism as claimed in claim 4, wherein the action of the actuator mechanism returning to its rest position sucks air into the air chamber via an outlet of the dispenser mechanism, causing any foam remaining in the outlet to be sucked back into the air chamber.

7. A dispenser mechanism as claimed in claim 1, wherein the liquid chamber has a piston and a one way valve to permit liquid to enter the chamber when the piston is withdrawn from the chamber, wherein the dispenser mechanism includes a transport cap arranged to prevent accidental operation of the actuator mechanism in transit and to keep the actuator mechanism in a fully depressed position where the piston of the liquid chamber is in contact with the one way valve and maintains the valve in a closed position.

8. A dispenser mechanism for a foamed product comprises: a liquid chamber arranged to receive a liquid product; an air chamber arranged to receive air; an actuator mechanism; and a foaming chamber, the actuator mechanism comprising a shaft, displacement of which simultaneously reduces the volume of both the liquid and air chambers and forces the air and liquid within the respective chambers to enter the foaming chamber, wherein the foaming chamber is formed integrally within the shaft and a diffuser is located in the shaft through which the liquid enters the foaming chamber, the diffuser defining a plurality of distributed channels, each channel having a predetermined cross section such that in use the liquid is forced through the channels and enters the foaming chamber as a plurality of jets, wherein the diffuser is in the form of a rigid disc located within the shaft, wherein the inner wall of the shaft and the diffuser define the plurality of distributed channels.

9. A dispenser mechanism as claimed in claim 8 wherein the diffuser has recesses about its outer periphery, which recesses define with the inner wall of the shaft said plurality of channels.

10. A dispenser mechanism as claimed in claim 1, wherein the diffuser comprises a rigid disc with a plurality of apertures extending there through.

11. A dispenser mechanism as claimed in claim 1, wherein the shaft comprises an upper component and a lower component, each moulded as a single piece, wherein the upper component includes a first piston and a diffuser, the lower component includes a second piston and an outlet passage of the mechanism.

12. A dispenser mechanism as claimed in claim 11, wherein the upper component of the shaft further comprises a retaining disc integrally moulded with the upper component, an edge of the retaining disc and an inner wall of the shaft being arranged to engage with each other to lock the upper and lower components together.

13. A dispenser mechanism as claimed in claim 1, arranged to be manually operated.

14. A dispenser mechanism as claimed in claim 1, further comprising a user interface for receiving a single stroke actuation by a user, for dispensing a predetermined quantity of product to the user on a full stroke of the dispenser mechanism and a linkage mechanism for transferring any displacement of the user interface to the dispensing mechanism, wherein the linkage mechanism permits the user interface to be operated to the full extent permitted by the interface and transmit to the dispenser mechanism only as much of the operation of the interface as is required to permit the dispenser mechanism to dispense the predetermined amount of product.

15. A dispenser mechanism as claimed in claim 14, wherein the linkage mechanism comprises a resilient device arranged between the interface and the dispenser mechanism, the properties of the resilient device being such as to fully actuate the dispenser mechanism on operation of the interface but which resilient device absorbs any excess movement of the interface to prevent damage to the dispenser mechanism.

16. A dispenser mechanism as claimed in claim 15, wherein the linkage mechanism comprises a first plate connected to the user interface and arranged to move with the user interface, a second plate connected to the dispenser mechanism, and at least one resilient member arranged to act between the first plate and the second plate, the resilient member being selected such that it will cause the two plates to be displaced together in response to any movement of the user interface to cause the dispenser mechanism to be operated but which, when the dispenser mechanism reaches the end of its travel, permits the first plate to continue to be displaced whilst the second plate remains substantially stationary.

17. A dispenser mechanism as claimed in claim 14 for dispensing soap and arranged to be wall mounted and permit single handed one stroke operation.

18. A dispenser mechanism as claimed in claim 8, wherein the periphery of the diffuser is smooth with ridges or recesses formed on the inner wall of the shaft.

* * * * *